US010934060B2

(12) United States Patent
Lewis

(10) Patent No.: US 10,934,060 B2
(45) Date of Patent: Mar. 2, 2021

(54) MULTI-CHAMBER TUBE CONTAINER AND CAP

(71) Applicant: NATE Packaging, LLC, Belchertown, MA (US)

(72) Inventor: Ray Lewis, Belchertown, MA (US)

(73) Assignee: NATE Packaging, LLC, Belchertown, MA (US)

( * ) Notice: Subject to any disclaimer, the term of this patent is extended or adjusted under 35 U.S.C. 154(b) by 131 days.

(21) Appl. No.: 16/315,745

(22) PCT Filed: Jul. 6, 2017

(86) PCT No.: PCT/US2017/040916

§ 371 (c)(1),
(2) Date: Jan. 7, 2019

(87) PCT Pub. No.: WO2018/009676

PCT Pub. Date: Jan. 11, 2018

(65) Prior Publication Data

US 2019/0300243 A1 Oct. 3, 2019

Related U.S. Application Data

(60) Provisional application No. 62/359,666, filed on Jul. 7, 2016.

(51) Int. Cl.
*B65D 35/44* (2006.01)
*B65D 35/22* (2006.01)
(Continued)

(52) U.S. Cl.
CPC ..... *B65D 35/44* (2013.01); *B65D 35/22* (2013.01); *B65D 47/08* (2013.01);
(Continued)

(58) Field of Classification Search
CPC ..... B65D 35/22; B65D 35/242; B65D 1/04; B65D 47/2031; B65D 83/0005;
(Continued)

(56) References Cited

U.S. PATENT DOCUMENTS

2005/0279781 A1* 12/2005 Pugne ..... B65D 47/0804 222/556
2007/0095702 A1* 5/2007 Park ..... B65D 35/22 206/446
(Continued)

FOREIGN PATENT DOCUMENTS

CN 102105362 A 6/2011
CN 102107752 A 6/2011
(Continued)

OTHER PUBLICATIONS

"International Application Serial No. PCT/US2017/040916, International Search Report dated Oct. 4, 2017", 4 pgs.
(Continued)

*Primary Examiner* — Shawn M Braden
(74) *Attorney, Agent, or Firm* — Schwegman Lundberg & Woessner, P.A.

(57) ABSTRACT

A tube cap (104) for a multi-chamber tube container (102) comprises a base plate (106) and a lid (120). The base plate is coupleable to the multi-chamber tube container and has an opening disposed therein, wherein the opening is positionable in communication with at least a first tube head (114) of a first tube (112) of the multi-chamber tube container. The lid is removably coupleable to the base plate and has both a pintle (122) extending from and a gasket (124) disposed on an inner surface thereof. When the lid and the base plate are coupled, the pintle extends into and seals a first orifice (108) disposed in the first tube head and the gasket is urged into sealing contact with a second orifice (110) disposed in a second tube head (118) of a second tube (116) of the multi-chamber tube container.

20 Claims, 6 Drawing Sheets

(51) Int. Cl.

| | |
|---|---|
| ***B65D 47/08*** | (2006.01) |
| ***B65D 47/12*** | (2006.01) |
| ***B65D 53/04*** | (2006.01) |
| ***B65D 81/32*** | (2006.01) |
| *B65D 41/04* | (2006.01) |

(52) U.S. Cl.
CPC ..... *B65D 47/0804* (2013.01); *B65D 47/122* (2013.01); *B65D 53/04* (2013.01); *B65D 81/3261* (2013.01); *B65D 41/045* (2013.01)

(58) Field of Classification Search
CPC .. B65D 77/065; B65D 81/3244; B65D 35/44; B65D 47/08; B65D 47/0804; B65D 47/122; B65D 53/04; B65D 81/3261; B65D 41/045
See application file for complete search history.

(56) References Cited

U.S. PATENT DOCUMENTS

| | | | | |
|---|---|---|---|---|
| 2007/0267436 | A1* | 11/2007 | Abbott | B65D 35/22 222/94 |
| 2009/0277912 | A1* | 11/2009 | Wang | B65D 47/2056 220/526 |
| 2012/0145704 | A1* | 6/2012 | Detrois | B65D 11/04 220/4.01 |
| 2015/0203253 | A1* | 7/2015 | Lee | B65D 35/44 222/214 |
| 2018/0290785 | A1* | 10/2018 | Jung | B65D 1/323 |

FOREIGN PATENT DOCUMENTS

| | | | |
|---|---|---|---|
| CN | 202912085 | U | 5/2013 |
| CN | 104755383 | A | 7/2015 |
| CN | 204688663 | U | 10/2015 |
| CN | 109689517 | A | 4/2019 |
| CN | 109689517 | B | 7/2020 |
| DE | 3514133 | A1 | 10/1986 |
| GB | 209920 | A | 1/2014 |
| WO | WO-2018009676 | A1 | 1/2018 |

OTHER PUBLICATIONS

"International Application Serial No. PCT/US2017/040916, Written Opinion dated Oct. 4, 2017", 7 pgs.
"Chinese Application Serial No. 201780048875.0, Office Action dated Sep. 2, 2019", W/ English Translation, 17 pgs.

* cited by examiner

MULTI-CHAMBER TUBE CONTAINER AND CAP

RELATED APPLICATIONS

This application is a U.S. National Stage Filing under 35 U.S.C. 371 from International Application No. PCT/US2017/040916, filed on Jul. 6, 2017, and published as WO 2018/009676, which claims the benefit of priority to U.S. Provisional Patent Application Ser. No. 62/359,666, filed Jul. 7, 2016, the content of which are incorporated herein by reference in their entireties.

FIELD

The present disclosure relates to a multi-chamber tube container having a sealable cap with a plurality of orifices disposed therein.

BACKGROUND

This section provides background information related to the present disclosure, which is not necessarily prior art.

The use of plastic tube packaging is prevalent in the cosmetics, pharmaceutical, and food packaging industries for packaging thick liquids and pastes. Conventional plastic tube packaging consists of a single chamber tube package that dispenses a single substance when squeezed. In certain instances, it can be desirable to maintain two components of a product in separate chambers, mixing them only at the time of dispensation. Accordingly, multiple-chamber tubes have been developed. Dispensing product from and sealing multi-chamber tubes can be challenging.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

The present inventor has recognized that dispensing product from and, additionally or alternatively, sealing a multi-chamber tube container can be problematic. Devices, systems, and methods for dispensing product from and, additionally or alternatively, sealing a multi-chamber tube container are therefore desirable. Accordingly, the present teachings provide for multi-chamber tube container caps and associated systems and methods. In one aspect, the present disclosure can provide for a multi-chamber tube container comprising a tube cap. The tube cap can comprise a base plate that can be coupleable to the multi-chamber tube container. The base plate can comprise an opening disposed therein. The opening can be positionable in communication with a first tube head of a first tube or a second tube head of a second tube of the multi-chamber tube container. The tube cap can further comprise a lid that can be removably coupleable to the base plate. The lid can comprise a pintle extending from an inner surface of the lid and, additionally or alternatively, a gasket disposed on the inner surface of the lid. When the lid and the base plate are coupled, the pintle can extend into and seal a first orifice disposed in the first tube head and, additionally or alternatively, the gasket can be urged into sealing contact with a second orifice disposed in the second tube head of the second tube of the multi-chamber tube container. The first orifice can be located in a central portion of the base plate. Additionally or alternatively, the second orifice can comprise a plurality of second orifices.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
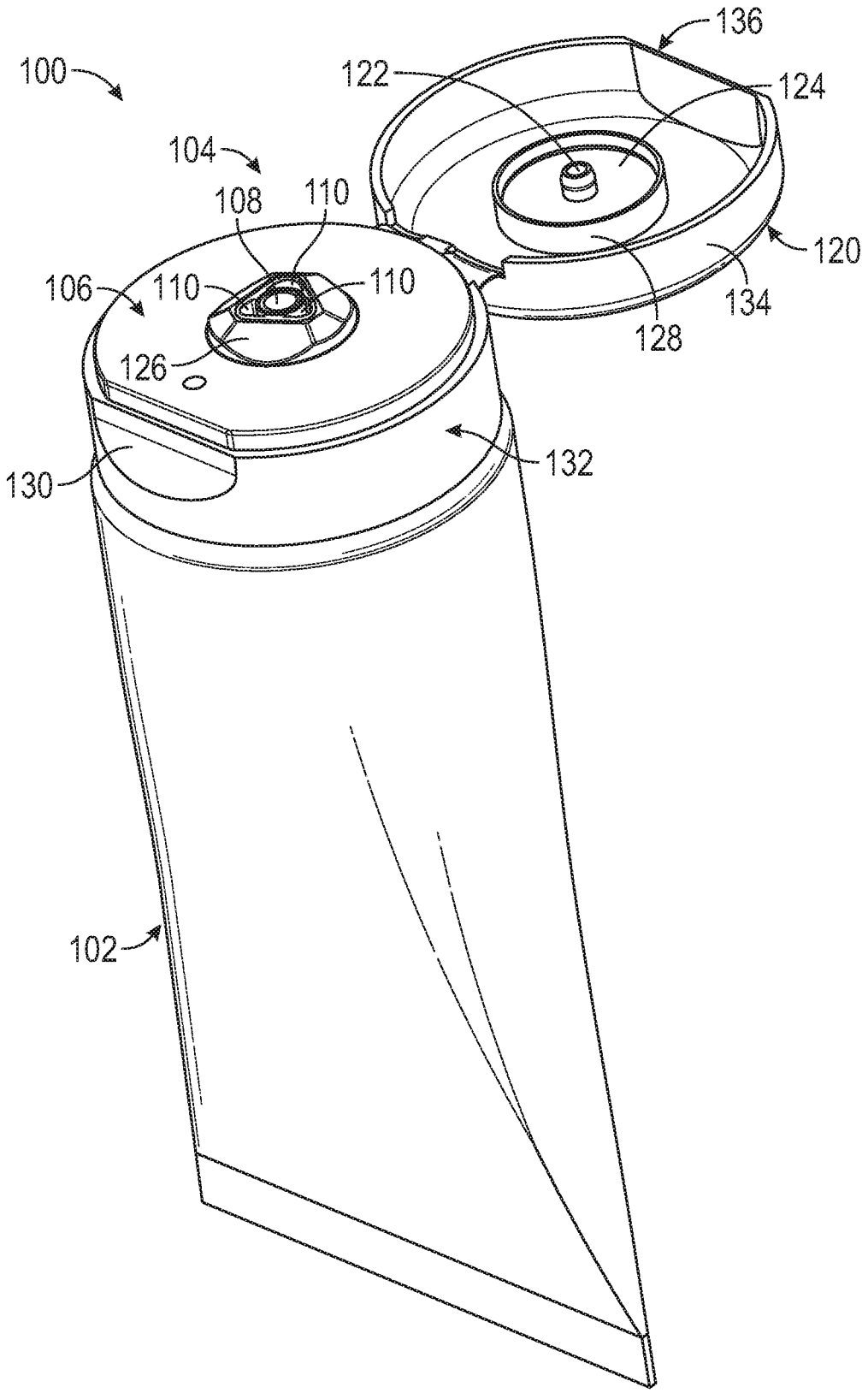
FIG. 1 illustrates a multi-chamber tube container with the cap in an open position.
Figure 2:
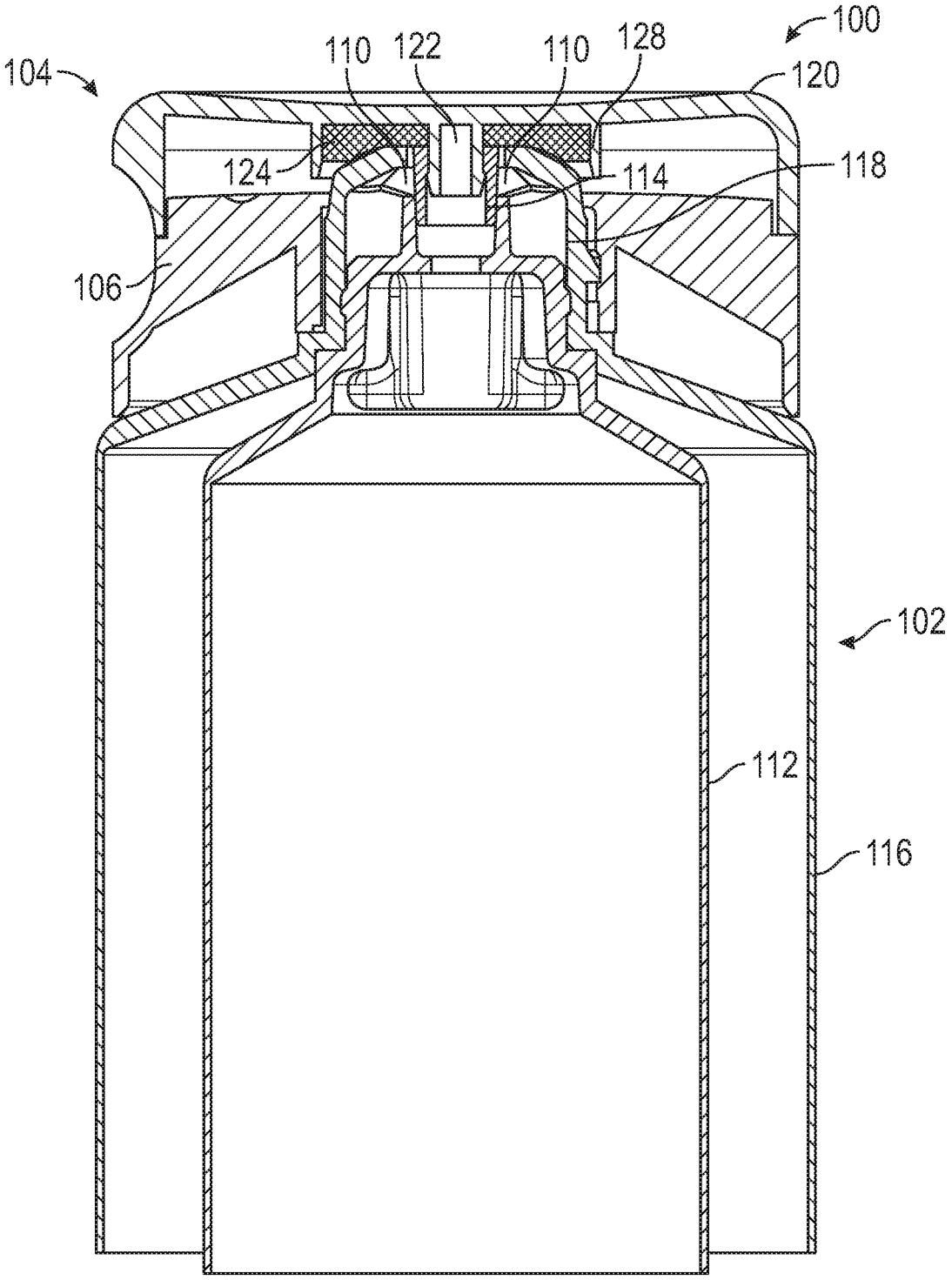
FIG. 2 illustrates a cross-sectional view of a multi-chamber tube container with the cap in a closed position.
Figure 3:
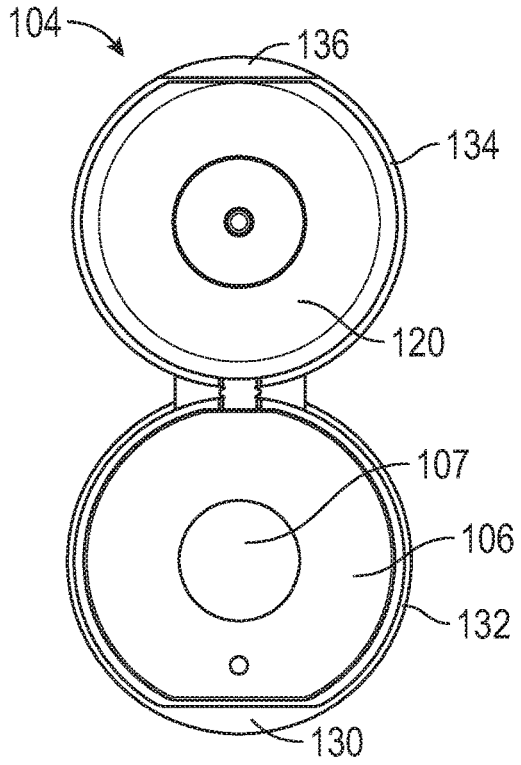
FIG. 3 illustrates a top view of a tube cap in an open position.
Figure 4:
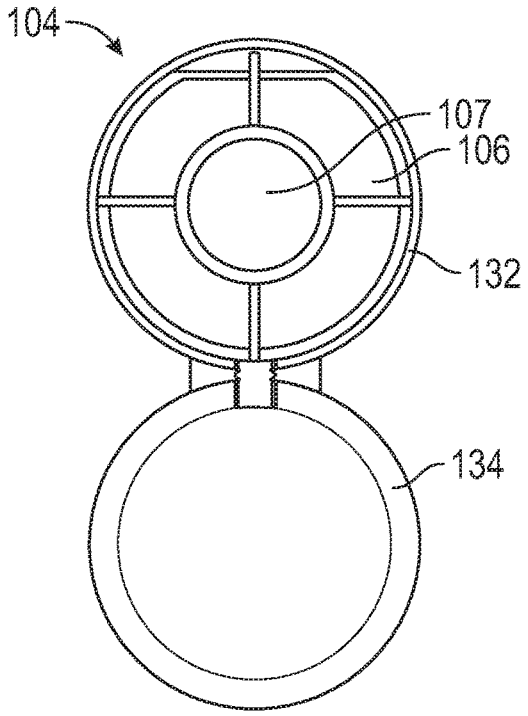
FIG. 4 illustrates a bottom view of a tube cap in an open position.
Figure 5:
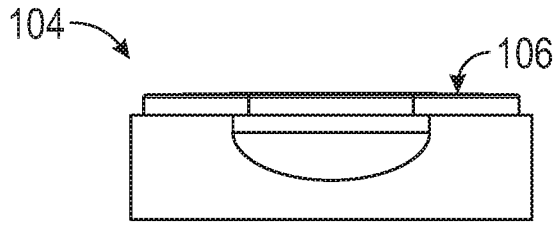
FIG. 5 illustrates a front side view of a tube cap in an open position.
Figure 6:
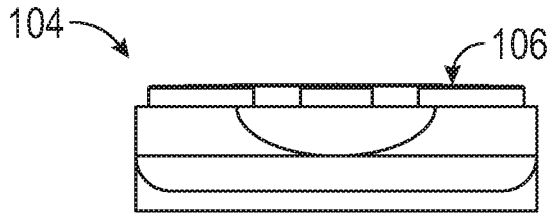
FIG. 6 illustrates a back side view of a tube cap in an open position.
Figure 7:
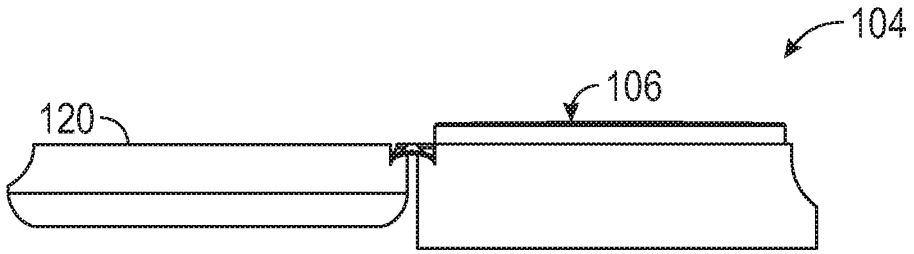
FIG. 7 illustrates a left side view of a tube cap in an open position.
Figure 8:
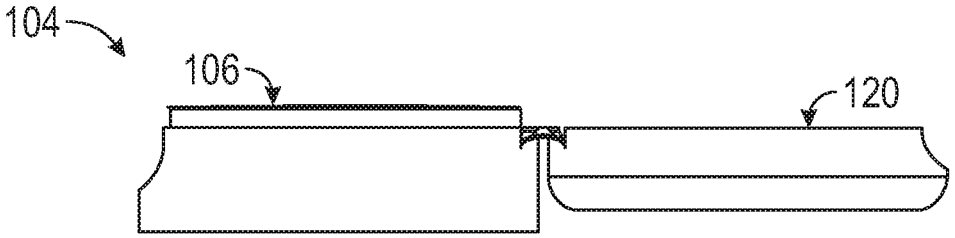
FIG. 8 illustrates a right side view of a tube cap in an open position.

Example embodiments will now be described more fully with reference to the accompanying drawings.

The present teachings provide for multi-chamber tube container caps and associated systems and methods. Such tube caps and associated systems and methods can provide for dispensing of product from and, additionally or alternatively, sealing of a multi-chamber tube container. Such tube caps and multi-chamber tube containers can enable separate substances to be dispensed simultaneously from separate containers and, additionally or alternatively, mixed at the point of use.

With initial reference to FIGS. 1-8, a system 100 comprises a multi-chamber tube container 102 comprising a tube cap 104. The tube cap 104 can comprise a base plate 106 that can be coupleable to the multi-chamber tube container 102 and a lid 120 that can be removably coupleable to the base plate 106.

In one aspect, the base plate 106 can comprise an opening 107 for receiving a first tube head 114 of a first tube 112 and a second tube head 118 of a second tube 116 of the multi-chamber tube container. A first orifice 108 can be disposed in the first tube head 114 and a second orifice 110 can be disposed in a second tube head 118. A top portion of either or both of the first tube head 114 and the second tube head 116 can be circumscribed by a transition surface 126 extending upward from the base plate 106 around the opening 107. The transition surface 126 can be either or both beveled and chamfered.

In another aspect, the first orifice 108 can be located in a central portion of the base plate 106 and each of the plurality of second orifices 110 can be spaced circumferentially about the first orifice 108 of the multi-chamber tube container 102. Each of the first tube head 114 and the second tube head 118 can optionally be circumscribed by a transition surface 126 when the tube cap is engaged with the tube.

In another aspect, the lid 120 can comprise a pintle 122 extending from an inner surface of the lid 120 and, additionally or alternatively, a gasket 124 disposed on the inner surface of the lid 120. The lid can optionally further include a gasket skirt 128 extending from the inner surface of the lid 120. The gasket skirt 128 can bound the outer circumferential edge of the gasket 124 and can constrain the gasket 124 from lateral expansion upon compression. When the lid 120 and the base plate 106 are coupled, the pintle 122 can extend into and seal the first orifice 108 and, additionally or alternatively, the gasket 124 can be urged into sealing contact with the second orifice 110 (or plurality of second orifices 110). At least a portion of the pintle 122 can be tapered from a first point to a second point spaced farther from the lid from the first point.

In one aspect, the lid 120 can be hingedly coupled to the base plate 106. The pintle 122 and first orifice 108 can cooperate to bias the lid 120 and base plate 106 in the closed position upon a user applying a sufficient closing force to couple the lid 120 and base plate 106 via engagement of the pintle 122 in the first orifice 108. Conversely, upon a user applying an opposite and sufficient opening force, the pintle 122 can be disengaged from the first orifice 108 to bias the lid 120 and the base plate 106 to an open position.

In an optional aspect, the lid 120 and the base plate 106 comprise further latching features to augment pintle/first orifice engagement mechanism described above. The base plate 106 can comprise a thumb plate 130 disposed on a portion of a base plate skirt 132 extending downward from the circumferential edge of the base plate 106. The lid 120 can comprise a lid skirt 134 extending from the inner surface of the lid 120. The lid skirt 134 can comprise a latch plate 136 that is complementary to the thumb plate 130. The thumb plate 130 can have at least one protrusion disposed thereon that cooperates with the latch plate 136 to further bias the lid 120 and the base plate 106 in the closed position upon a user applying sufficient closing force to engage the latching feature. Conversely, upon a user applying an opposite and sufficient opening force, the latch plate 136 can disengage from the thumb plate 130 to bias the lid 120 and the base plate 106 into an open position.

Figure 9A:
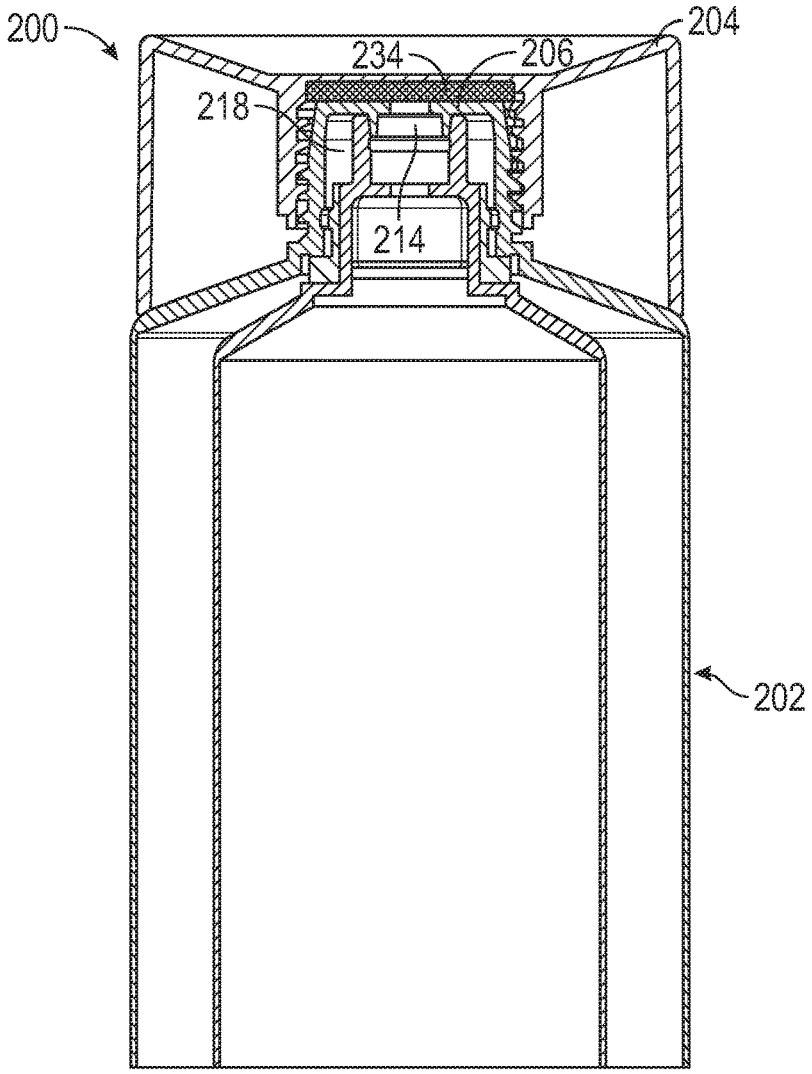
FIG. 9A illustrates a cross-sectional view of another embodiment of a multi-chamber tube with the cap in a closed position and FIG. 9B illustrates a bottom view of the tube cap of FIG. 9A.
Figure 9B:
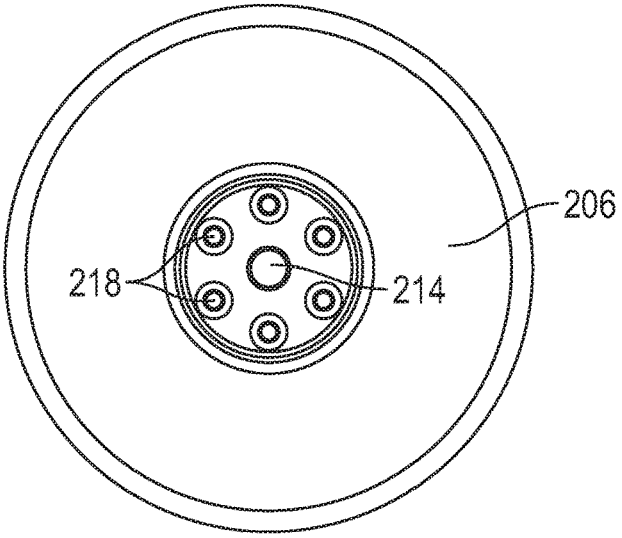

In another embodiment illustrated in FIGS. 9A-9B, a system 200 can comprise a multiple-chamber tube container 202 having a tube cap 204 that can be threadably coupleable to the base plate 206. In an additional or alternative aspect, the tube cap 204 can further comprise a gasket 234 extending from a bottom surface thereof. The gasket 234 can fixedly engage at least one of the first tube head 214 and the second tube head 218 of the multi-chamber tube 202 when the tube cap 204 is urged into mating contact with the multi-chamber tube container 202.

Figure 10:
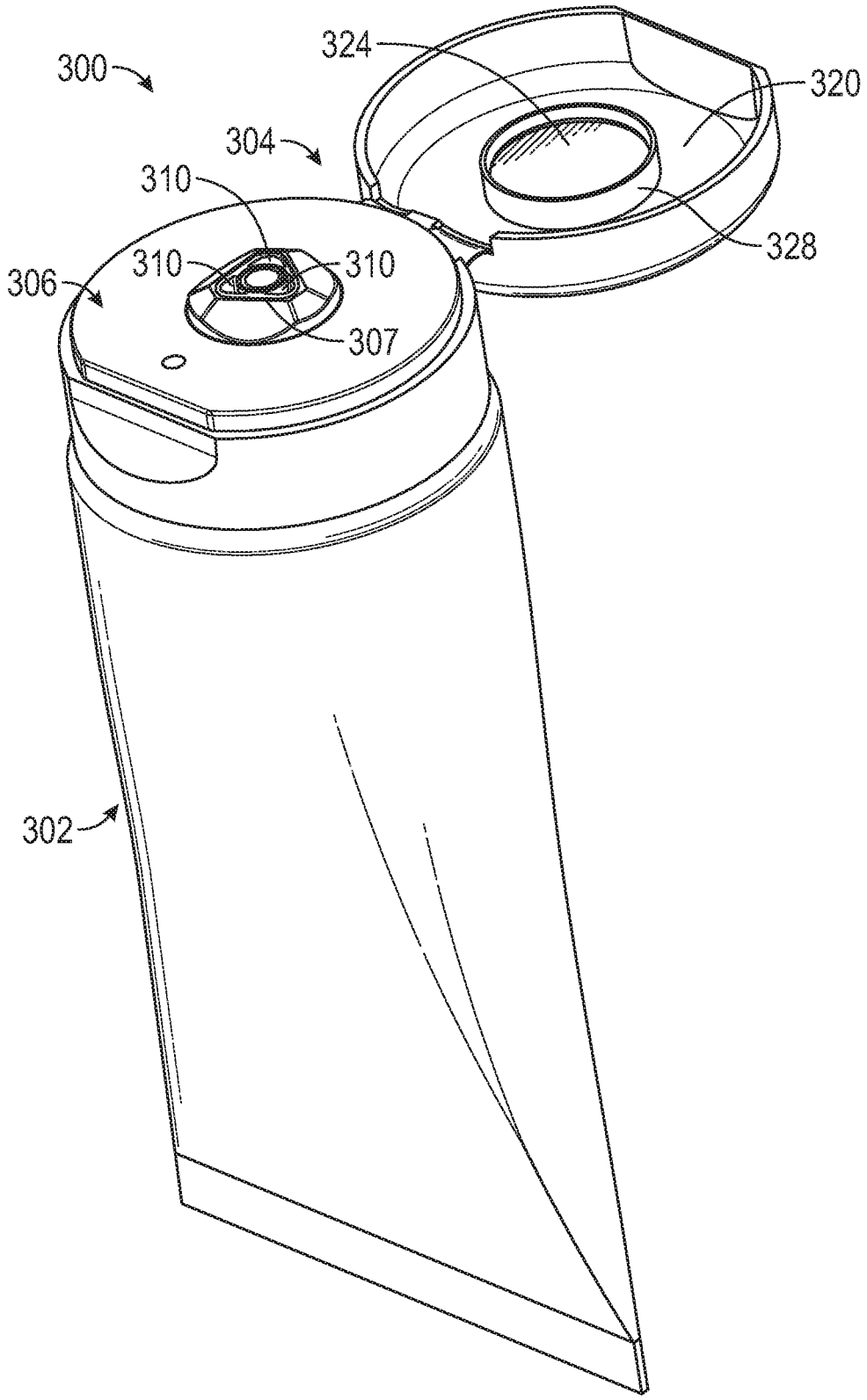
FIG. 10 illustrates another embodiment of a tube cap in an open position.

In another embodiment illustrated in FIG. 10, a system 300 can comprise a multiple-chamber tube container 302 comprising a tube cap 304. The tube cap 304 can comprise a base plate 306 that can be coupleable to the multi-chamber tube container 302. The tube cap 304 can comprise an opening 307 disposed therein for receiving at least one tube head of the multi-chamber tube. The multi-chamber tube has a tube head with at least one orifice 310 disposed therein corresponding to each tube thereof. The tube cap 304 can further comprise a lid 320 that can be removably coupleable to the base plate 306. The lid 320 can comprise a gasket 324 disposed on an inner surface of the lid 320 that can optionally be surrounded by gasket skirt 328 substantially as described above with respect to FIGS. 1-8. When the lid 320 and the base plate 306 are coupled, the gasket 324 can be urged into sealing contact with each of the plurality of orifices 310.

Various Notes & Examples

Example 1 is a tube cap for a multi-chamber tube container that can comprise a base plate coupleable to the multi-chamber tube container and can comprise an opening disposed therein. The opening can be positionable in communication with a first tube head of a first tube or a second tube head of a second tube of the multi-chamber tube container. The tube cap can further comprise a lid removably coupleable to the base plate. The lid can comprise a pintle extending from and a gasket disposed on an inner surface of the lid. When the lid and the base plate are coupled, the pintle can extend into and seal a first orifice disposed in the first tube head and the gasket can be urged into sealing contact with a second orifice disposed in a second tube head of a second tube of the multi-chamber tube container.

In Example 2, the subject matter of Example 1 optionally includes wherein the pintle can be located in a central portion of the lid.

In Example 3, the subject matter of any one or more of Examples 1-2 optionally includes wherein the second orifice can comprise a plurality of second orifices.

In Example 4, the subject matter of Example 3 optionally includes wherein each of the plurality of second orifices can be spaced circumferentially about the first orifice.

In Example 5, the subject matter of any one or more of Examples 3-4 optionally include wherein the gasket can be urged into sealing contact with each of the plurality of second orifices when the lid and base plate are coupled.

In Example 6, the subject matter of any one or more of Examples 1-5 optionally include wherein a top portion of each of the first tube head and the second tube head can be circumscribed by a transition surface extending upward from the base plate when the lid and base plate are coupled.

In Example 7, the subject matter of Example 6 optionally includes wherein the transition surface can be beveled.

In Example 8, the subject matter of any one or more of Examples 6-7 optionally include wherein the transition surface can be chamfered.

In Example 9, the subject matter of any one or more of Examples 1-8 optionally include wherein the base plate and lid can be hingedly coupled.

In Example 10, the subject matter of any one or more of Examples 1-9 optionally include wherein the base plate and lid can be threadably coupleable.

In Example 11, the subject matter of any one or more of Examples 1-10 optionally include wherein the lid can further comprise a gasket skirt extending from the inner surface of the lid that bounds an outer circumferential edge of the gasket.

In Example 12, the subject matter of any one or more of Examples 1-11 optionally include wherein the pintle can be tapered from a first point adjacent to the lid to a second point spaced from the lid.

In Example 13, the subject matter of any one or more of Examples 1-12 optionally include wherein the base plate can comprise a seal ring extending from a bottom surface thereof, wherein the seal ring fixedly engages at least one of the first tube head and the second tube head when the tube cap is urged into mating contact with the multi-chamber tube container.

Example 14 is a multi-chamber tube container that can comprise a tube cap that can comprise a base plate coupleable to the multi-chamber tube container and having an opening disposed therein. The opening can be positionable in communication with a first tube head of a first tube or a second tube head of a second tube of the multi-chamber tube container. The multi-chamber tube container can further comprise a lid removably coupleable to the base plate. The lid can comprise a pintle extending from and a gasket disposed on an inner surface of the lid. When the lid and the base plate are coupled, the pintle can extend into and seal a first orifice disposed in the first tube head and the gasket can be urged into sealing contact with a second orifice disposed in a second tube head of a second tube of the multi-chamber tube container.

Example 15 is a tube cap for a multiple-chamber tube container that can comprise a base plate coupleable to the multiple-chamber tube container and having an opening disposed therein. When the tube cap is coupled to the multiple chamber tube, the opening can be positionable in communication with an outer tube of the multiple-chamber tube. The tube cap can further comprise a lid removably coupleable to the base plate. The lid can comprise a gasket disposed on an inner surface of the lid. When the lid and the base plate are coupled, the gasket can be urged into sealing contact with a first orifice disposed in the outer tube and a second orifice disposed in an inner tube.

In Example 16, the subject matter of Example 15 optionally includes wherein the base plate and lid can be hingedly coupled.

In Example 17, the subject matter of any one or more of Examples 15-16 optionally include wherein the base plate and lid can be threadably coupleable.

In Example 18, the subject matter of any one or more of Examples 15-17 optionally include wherein the lid can further comprise a gasket skirt extending from the inner surface of the lid that bounds an outer circumferential edge of the gasket.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A tube cap for a multi-chamber tube container, comprising:

a base plate coupleable to the multi-chamber tube container and comprising an opening disposed therein, wherein the opening is positionable in communication with a first tube head of a first tube or a second tube head of a second tube of the multi-chamber tube container; and a lid removably coupleable to the base plate, wherein the lid comprises a pintle extending from and a gasket disposed on an inner surface of the lid;

wherein, when the lid and the base plate are coupled, the pintle extends into and seals a first orifice disposed in the first tube head and the gasket is urged into sealing contact with a second orifice disposed in the second tube head of the second tube of the multi-chamber tube container, wherein the base plate comprises a seal ring extending from a bottom surface thereof, and wherein the seal ring fixedly engages at least one of the first tube head and the second tube head when the tube cap is urged into mating contact with the multi-chamber tube container.

2. The tube cap of claim 1, wherein the pintle is located in a central portion of the lid.

3. The tube cap of claim 1, wherein the second orifice comprises a plurality of second orifices.

4. The tube cap of claim 3, wherein each of the plurality of second orifices are spaced circumferentially about the first orifice.

5. The tube cap of claim 3, wherein the gasket is urged into sealing contact with each of the plurality of second orifices when the lid and the base plate are coupled.

6. The tube cap of claim 1, wherein a top portion of each of the first tube head and the second tube head are circumscribed by a transition surface extending upward from the base plate when the lid and the base plate are coupled.

7. The tube cap of claim 6, wherein the transition surface is beveled.

8. The tube cap of claim 6, wherein the transition surface is chamfered.

9. The tube cap of claim 1, wherein the base plate and the lid are hingedly coupled.

10. The tube cap of claim 1, wherein the base plate and the lid are threadably coupleable.

11. The tube cap of claim 1, wherein the lid further comprises a gasket skirt extending from the inner surface of the lid that bounds an outer circumferential edge of the gasket.

12. The tube cap of claim 1, wherein the pintle is tapered from a first point adjacent to the lid to a second point spaced from the lid.

13. A tube cap attached to a multi-chamber tube container comprising an outer tube head and an inner tube head, the tube cap comprising:

a base plate coupled to the outer tube head of the multi-chamber tube container, the base plate defining:

an opening in communication with the inner tube head of the multi-chamber tube container, and an orifice in communication with the outer tube head of the multi-chamber tube container; and a lid removably coupleable to the base plate, wherein the lid comprises:

a pintle extending from an inner surface of the lid and, and a gasket disposed on an inner surface of the lid and encircling the pintle at an intersection of the pintle and the inner surface of the lid, wherein, when the lid engages the base plate, the pintle extends into and seals the opening in the base plate and an opening defined by the inner tube head, and the gasket contacts and seals the orifice of the base plate.

14. The tube cap of claim 13, wherein the pintle is located in a central portion of the lid.

15. The tube cap of claim 13, wherein a top portion of each of the outer tube head and the inner tube head are circumscribed by a transition surface extending upward from the base plate when the lid and the base plate are coupled.

16. The tube cap of claim 13, wherein the base plate and the lid are hingedly coupled.

17. The tube cap of claim 13, wherein the second orifice comprises a plurality of second orifices spaced circumferentially about the first orifice.

18. A tube cap attached to a multi-chamber tube container comprising an outer tube head and an inner tube head, the tube cap comprising:

a base plate coupled to the outer tube head of the multi-chamber tube container, the base plate defining:

an opening in communication with the inner tube head of the multi-chamber tube container, and a plurality of orifices in communication with the outer tube head of the multi-chamber tube container; and a lid removably coupleable to the base plate, wherein the lid comprises:

a pintle extending from an inner surface of the lid and, and a gasket disposed on an inner surface of the lid and encircling the pintle at an intersection of the pintle and the inner surface of the lid, wherein, when the lid engages the base plate, the pintle extends into and seals the opening in the base plate and an opening defined by the inner tube head, and the gasket contacts and seals each of the plurality of orifices of the base plate.

19. The tube cap of claim 13, wherein the lid further comprises a gasket skirt extending from the inner surface of the lid that bounds an outer circumferential edge of the gasket.

20. The tube cap of claim 13, wherein a top portion of each of the outer tube head and the inner tube head are circumscribed by a transition surface extending upward from the base plate when the lid and the base plate are coupled.

* * * * *